United States Patent [19]

Frazier et al.

[11] Patent Number: 4,646,936

[45] Date of Patent: Mar. 3, 1987

[54] PILL DISPENSER

[75] Inventors: Thomas A. Frazier, Williamsport; Allen D. Lowe, Montgomery, both of Pa.

[73] Assignee: Ortho Pharmaceutical Corporation, Raritan, N.J.

[21] Appl. No.: 747,500

[22] Filed: Jun. 21, 1985

[51] Int. Cl.[4] ..... B65D 83/04

[52] U.S. Cl. ..... 221/5; 221/25; 221/86; 116/308; 206/534

[58] Field of Search ..... 221/2, 4–5, 221/25, 76, 86, 89, 69, 64, 82; 206/531–534, 538–539; 116/308

[56] References Cited

U.S. PATENT DOCUMENTS

| | | | |
|---|---|---|---|
| 3,199,489 | 8/1965 | Ruoss | 116/308 |
| 3,570,707 | 3/1971 | Finkel | 221/5 |
| 4,165,709 | 8/1979 | Studer | 221/86 X |

FOREIGN PATENT DOCUMENTS

| | | | |
|---|---|---|---|
| 1806343 | 6/1969 | Fed. Rep. of Germany | 221/2 |
| 442615 | 1/1968 | Switzerland | 206/534 |
| 1187060 | 4/1970 | United Kingdom | 221/82 |

*Primary Examiner*—Charles A. Marmor

*Attorney, Agent, or Firm*—Benjamin F. Lambert

[57] ABSTRACT

A dispenser for dispensing a series of different pills over a prescribed period. In all embodiments, the pill package disposed in the dispenser is locked in place and cannot be removed therefrom. In one embodiment, the daily indicator employed for designating the period the particular pills are to be taken can be preset to start the regimen on any day selected by the user. Also, after the first pill has been taken and the tray containing the pill package has been moved to dispense a second pill the indicator cannot be repositioned.

11 Claims, 13 Drawing Figures

FIG. 1
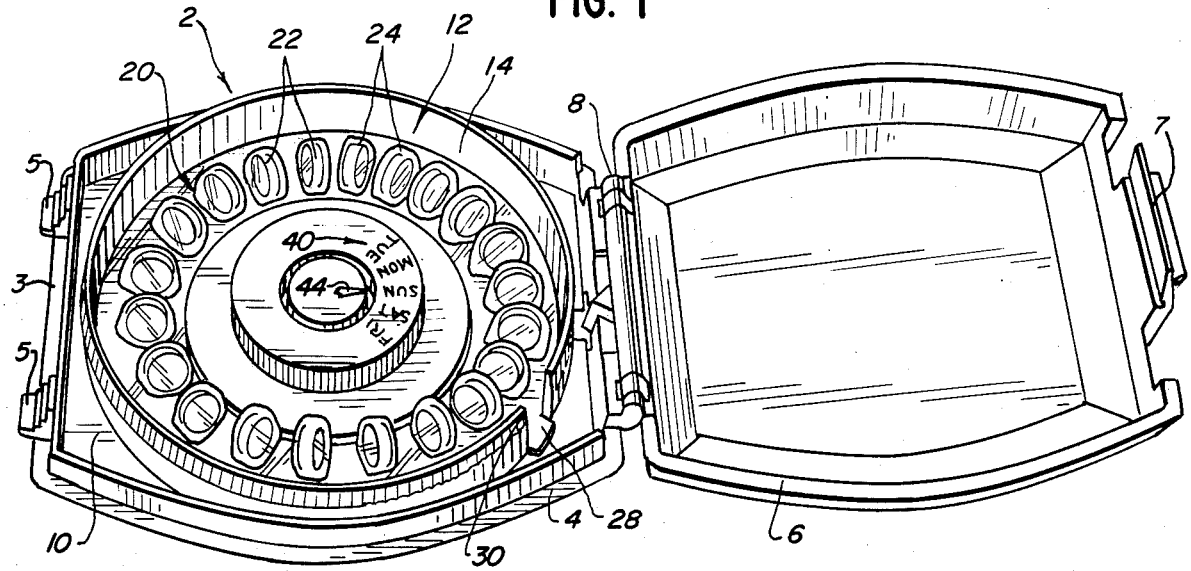
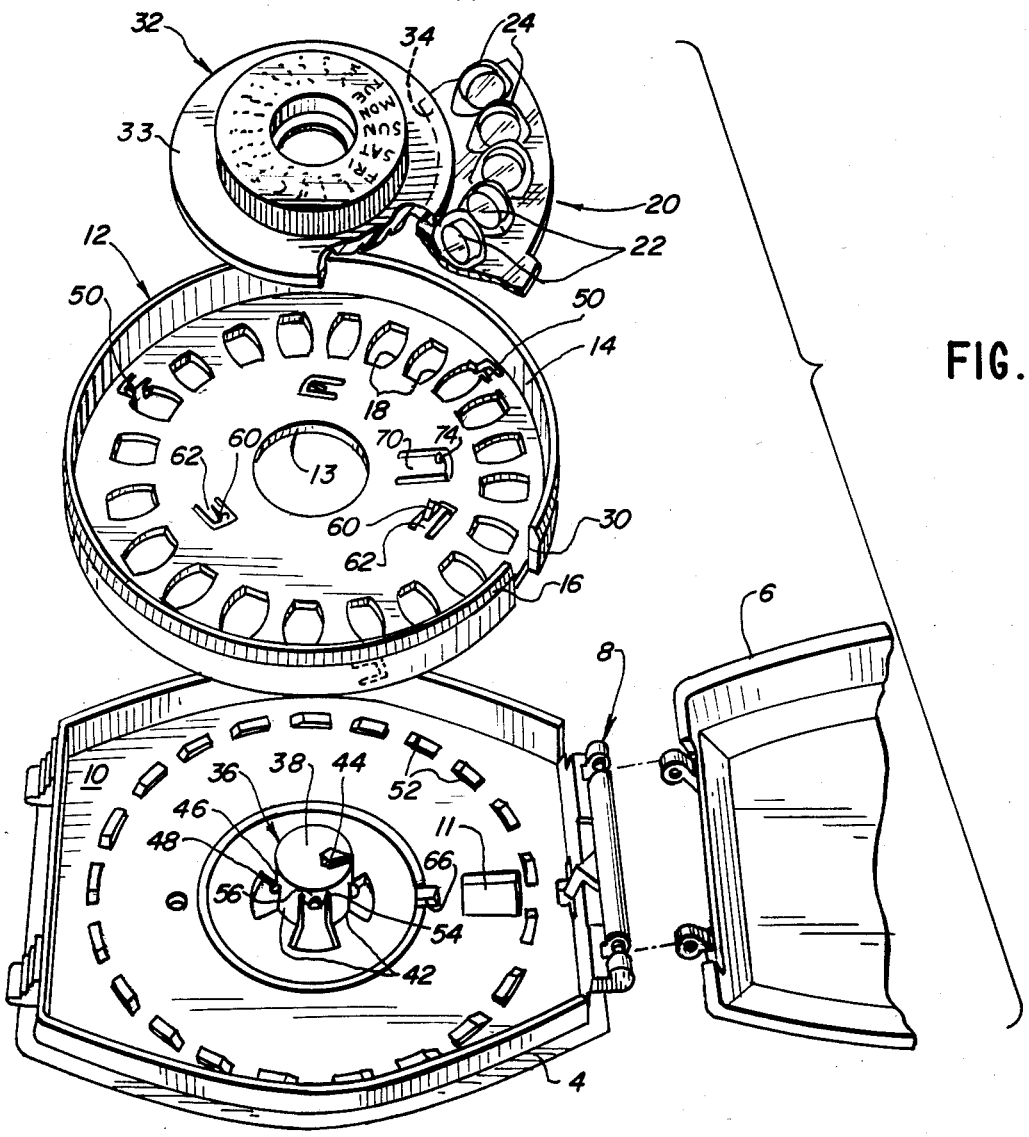
FIG. 2

FIG. 3
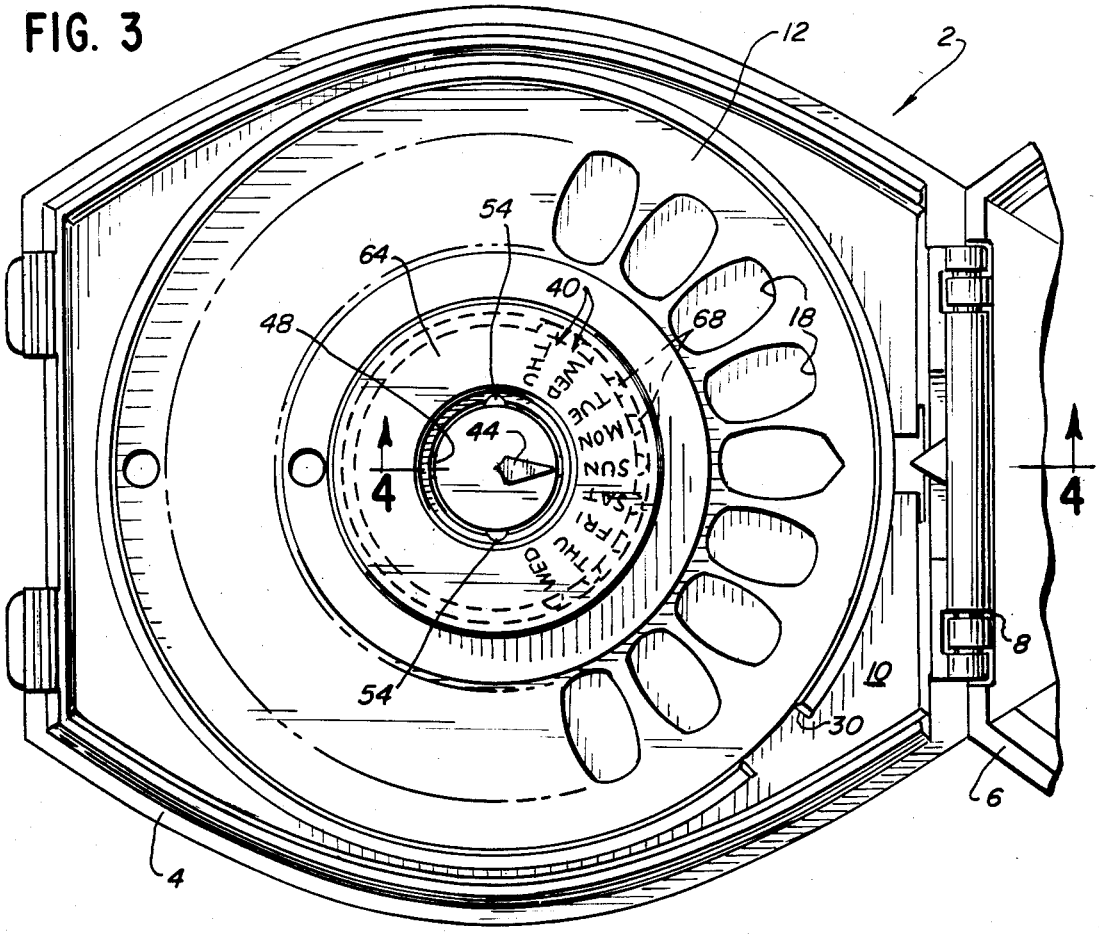
FIG. 9
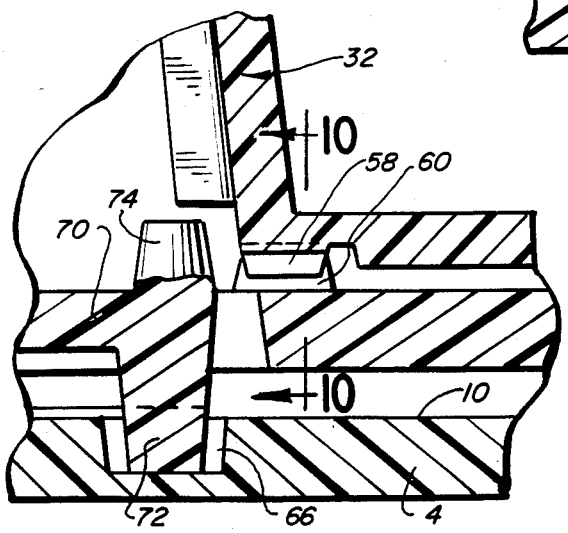
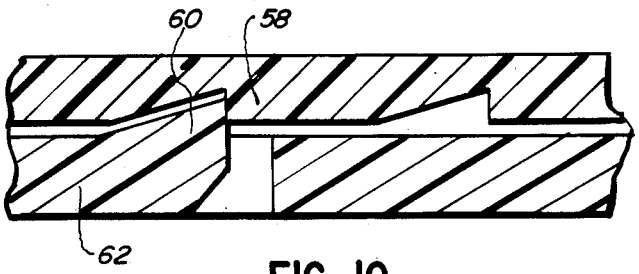
FIG. 10

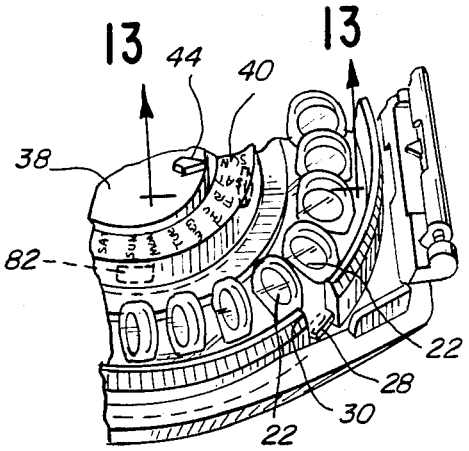
FIG. 11
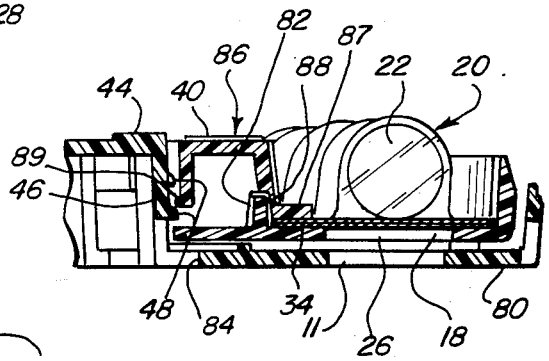
FIG. 13
FIG. 12
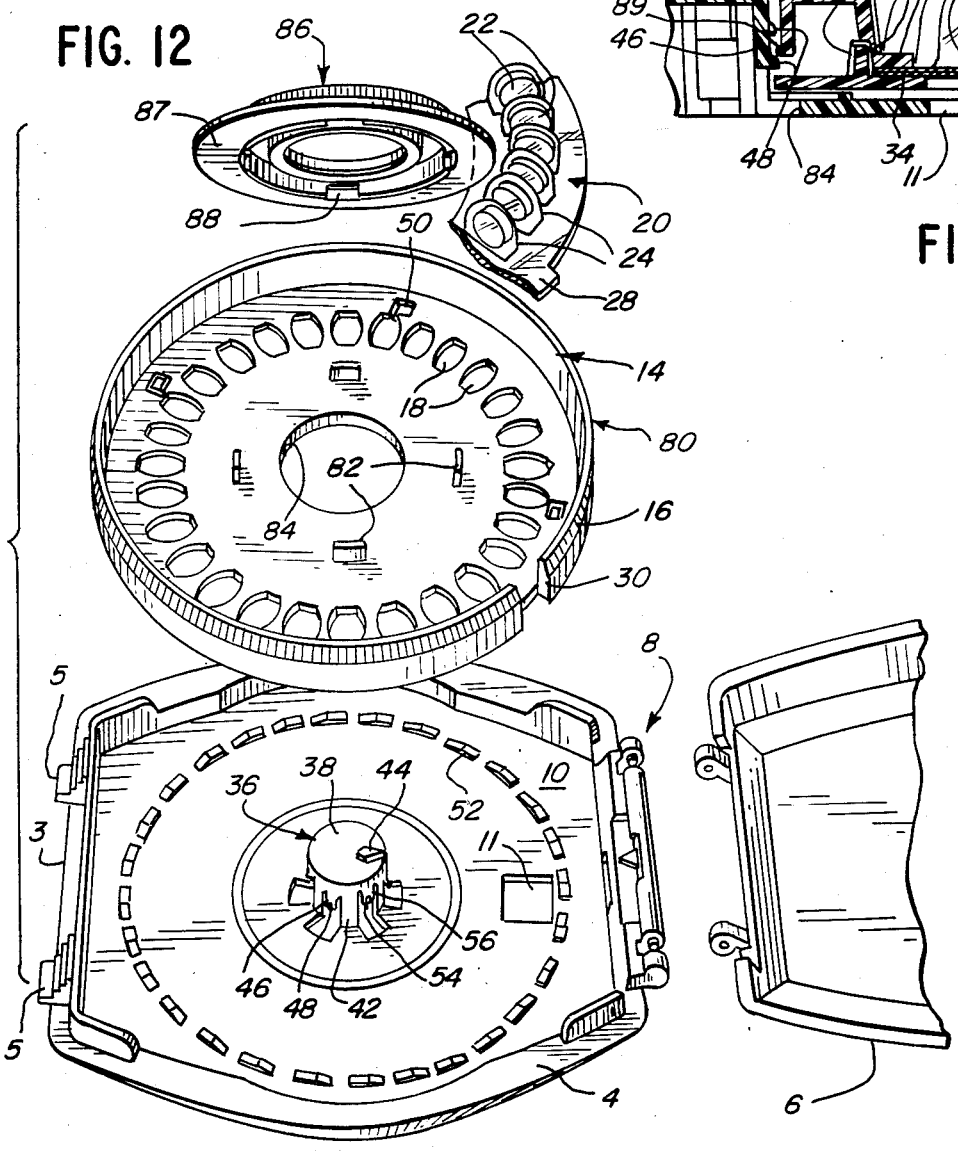

PILL DISPENSER

BACKGROUND OF THE INVENTION

The present invention relates to a novel pill or tablet dispenser which is used for dispensing pills at given specified periods. It contains an indicator mechanism for designating the prescribed time periods for taking the pills. A dispenser of this type is particularly applicable for the use of those drugs that are to be taken at regular intervals over an extended period of time, such as, birth control pills.

Dispensers of this type have been available, but usually permit removal of the tablet package and replacement with a substitute package without the user's knowledge.

Additionally, in the case of birth control pills, it is desirable that the first pill in the prescribed regimen be taken on a specific day, which with said pills is a time predetermined by the onset of the user's menstrual period. This, of course, can occur on any day of the week, and thus it is desirable that the indicator mechanism designating the days the pills in the dispenser are to be taken be adjustable so that the indicator can be positioned to coincide with the prescribed day of the week the first pill of the series is to be taken.

There are currently available on the market a number of different types of pill and tablet dispensers, such as those disclosed in U.S. Pat. Nos. 3,276,573, 3,651,927, 3,743,085, 3,800,940, 3,904,075, and assignee's U.S. Pat. No. 4,165,709. The dispensers disclosed in these patents are designed so that the user will be notified to take the tablet on a prescribed basis, such as, a daily basis, by providing an indicator that denotes the days of a week, but no provision is available for enabling one to preset the specific day of the week that the first tablet of a differing series of pills is to be taken in a fashion as simple and efficient as the dispenser disclosed in this application. It can be appreciated that if the indicator mechanism is not adjustable and is preset to require that the first pill of a regimen made of different pills is to be taken on a Sunday, and the user should take the first pill of a series on a Wednesday, the user could be at risk for a period of time, which is, to say the least, highly undesirable.

In applicant's application entitled "Tablet Dispenser" filed simultaneously with the instant application, there is a novel tablet dispenser which provides for the setting of the taking of the first pill of a series on any day of the week the user desires. In this dispenser the first tablet of the prescribed regimen is pre-positioned to be dispensed from the dispenser and the indicator mechanism is adjustable so that it can be set to indicate any day of the week the first tablet is to be taken. This tablet dispenser, while generally acceptable, has the aforementioned disadvantage in that the tablet package can be removed and replaced with a substitute package without the user's knowledge. In addition, the particular design of the indicator mechanism also permits inadvertent or accidental resetting of the time the tablets are to be taken by permitting movement of the indicator mechanism relative to the dispenser at any time after one or more tablets have been taken. These missing features, while normally not a problem, could be misused in that other tablets could be substituted for those normally sold with the dispenser and the user could get an inferior product, or different tablets, which would not serve the intended purpose. In the case of the movable indicator mechanism, if it were moved accidentally, the user could get confused and miss the taking of a pill or take it at the wrong time.

The instant application discloses several embodiments of a dispenser device which has advantages over those previously available including the presetting of the day on which the first pill is to be taken while preventing accidental movement of the indicating mechanism after it has been preset and the user has begun to use the pills from the dispenser, ready removal of the pill from the dispenser, compactness, and simplicity in operation and/or it does not have the disadvantage of permitting the pill package to be readily removed from the dispenser.

SUMMARY OF THE INVENTION

In accordance with the present invention, there is provided several embodiments of a novel pill dispenser in which the pill package is locked in position within the dispenser and thus does not permit ready removal of the pill package and substitution therefor. Also, one of the embodiments provides for the initial setting of whatever first day the user is to take the first pill of the regimen and prevents resetting of the starting day after it has originally been set, the first pill taken and a second pill placed in position to be taken.

In the subject novel dispenser, there is provided a rotatable tray in which the pill package is located. The tray has openings corresponding to the pills of the pill package. The tray is movable relative to an opening in the dispenser to permit dispensing of a pill from the package through the tray opening and dispenser opening when the opening in the dispenser is in alignment with the pill in the tray to be dispensed.

Located centrally of the dispenser is an indicator mechanism which in the instant application lists days of the week in alignment with each of the pills in the dispenser. Days are but one of the various indicia which could be listed on the indicator mechanism. The pill package is positioned in the tray so that the first pill of the regimen to be taken is disposed in position to be dispensed through the dispenser opening.

To secure the pill package in position in the dispenser, the indicating mechanism defines a flange portion that has a larger outer diameter than the inner diameter of the pill package. Thus, when the dispenser is assembled, the annular flange of the indicating mechanism extends over a portion of the pill package to positively lock the package in position in the tray and thus prevent removal thereof and replacement by a different package.

In one of the embodiments of this invention, the indicator is preset during manufacture to indicate a specific day, i.e., Sunday, the first pill of the pill package is to be taken. In a second embodiment, the user can preset the indicator to locate, in alignment with the dispenser opening, any day of the week the first pill of the pill package is to be taken. After the indicator mechanism has been properly positioned, movement of the tray to place a subsequent pill into position to be dispensed will carry along with it the indicator and thus the user will be cognizant of the pills that are to be taken on prescribed days. The taking of a pill will be denoted by its location in alignment between a pointer on a fixed central post of the dispenser, the day designated on the indicator, and the dispensing opening.

The operation of the tray relative to the dispenser housing is controlled by interengaging teeth mechanism that permits movement of the tray in one direction only (in the instant application clockwise) to align sequential tablets in position to be dispensed therefrom. In the embodiment allowing preselection of the first day of the regimen by the user, the indicating mechanism and tray define interengaging teeth that permit adjustment of the indicator relative to the tray in one direction also (in the instant application counterclockwise), and after initially being preset to the requisite day, moves with the tray. There is provided a novel interlock mechanism between the tray and indicator that prevents movement of the indicator relative to the tray after the first pill has been taken and the tray moved to dispense the second pill.

BRIEF DESCRIPTION OF THE DRAWINGS

Numerous other advantages and features of the present invention will become readily apparent from the following detailed description of the invention, from the claims, and from the accompanying drawings in which like numerals are employed to designate like parts throughout the same.

FIG. 1 is a perspective view of a pill dispenser incorporating the present invention;

FIG. 2 is an exploded partial perspective view partially broken away of the components of the dispenser;

FIG. 3 is a plan view of the tray portion of the dispenser with the tablet package removed;

FIG. 9 is a view taken along line 9—9 of FIG. 5;

FIG. 10 is a view taken along line 10—10 of FIG. 9;

FIG. 11 is a partial perspective view of a second embodiment of a pill dispenser incorporating this invention in which the dispenser has been filled and preset so the first pill is to be taken on a specific day of the week, i.e., Sunday;

FIG. 12 is an exploded partial perspective view partially broken away of the components of the dispenser shown in FIG. 11; and FIG. 13 is a view taken along line 13—13 of FIG. 11 with the pill package shown in position.

DETAILED DESCRIPTION

Figure 4:
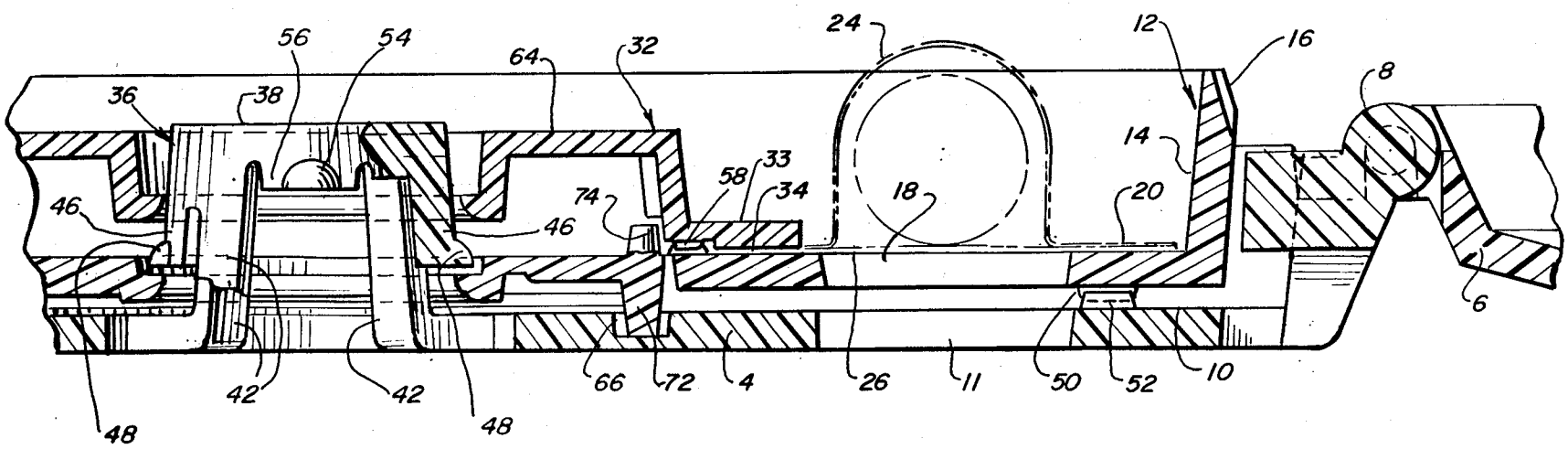
FIG. 4 is a view taken along line 4—4 of FIG. 3 with the pill package shown in position.
Figure 6:
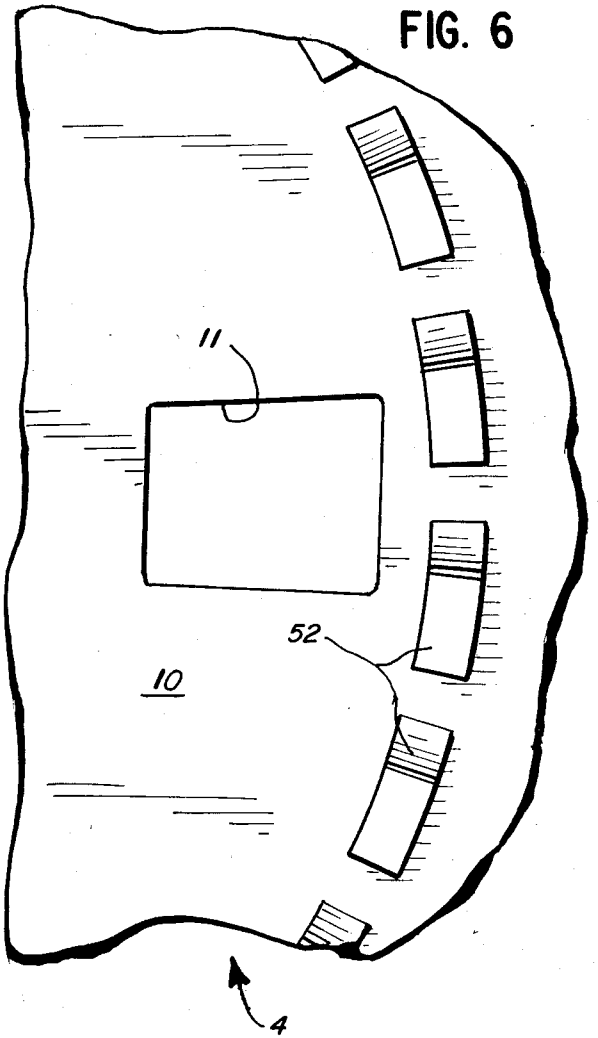
FIG. 6 is a partial plan view of the bottom housing of the dispenser.
Figure 7:
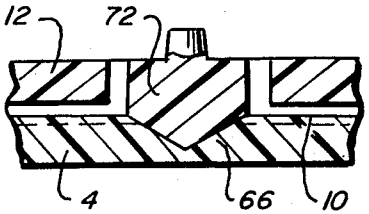
FIG. 7 is a view taken along line 7—7 of FIG. 5.
Figure 8:
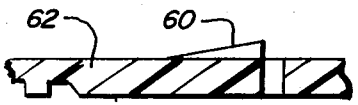
FIG. 8 is a view taken along line 8—8 of FIG. 5.
Figure 5:
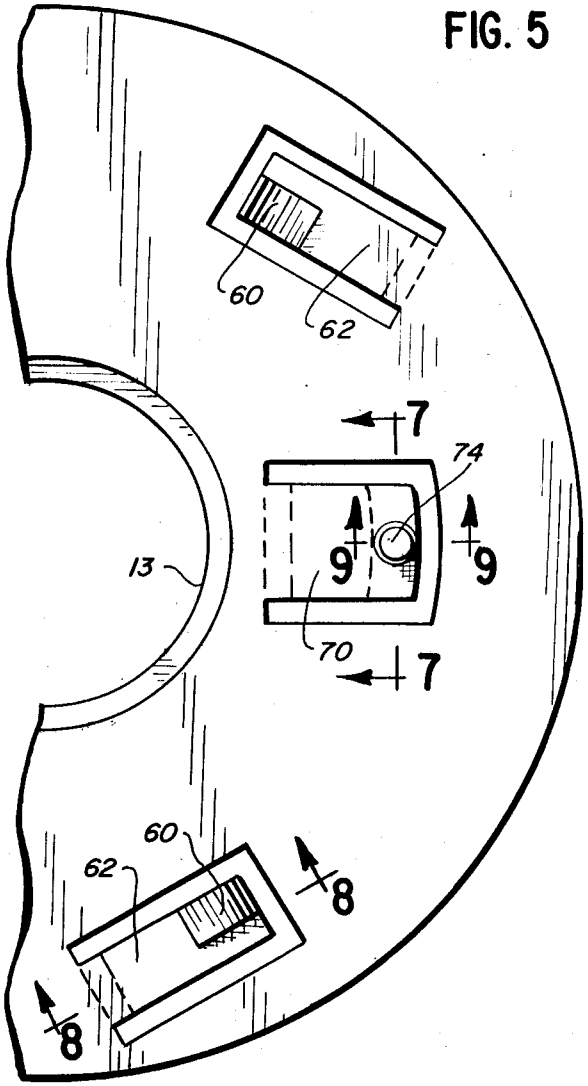
FIG. 5 is a plan view of a portion of the tray.

Referring first to FIGS. 1 and 2, there are shown the major components of the pill dispenser and to facilitate a general understanding thereof, it will first be described in general terms and hereinafter each of the components will be covered in detail.

The pill dispenser 2 consists of a bottom housing or support 4 and a cover 6 that is hinged at 8 to the support 4. A tab 7 on the cover 6 fits over a lip 3 of the support 4. Finger grips 5 are provided on the support for facilitating opening of the cover 6. Located on the bottom wall 10 of the support 4 is a rotatable circular tray 12 which has a sidewall 14. In the bottom wall 10 of the support is formed a dispensing opening 11 through which the pills are dispensed when they are to be taken. The upper portion 16 of the sidewall is sloped inwardly and defines a gripping portion to facilitate rotatable movement of the tray 12. Adjacent the sidewall, the tray contains a plurality of circumferentially spaced openings 18 through which pills are dispensed in the desired sequence.

Disposed within the tray 12 is a blister pill package 20 consisting of a circular array of pills 22 that correspond to the openings 18 in the tray 12. The pill package 12 is a blister pack containing pills 22 located in separate sections that are to be dispensed in a prescribed sequence. Specifically, the individual pills 22 are located within separate clear plastic compartments 24 the bottoms of which are closed by frangible sections 26 (see FIG. 4) that are broken away by the user pressing against a pill within a compartment to release the pill 22 from the package 20 when the pill 22 is to be taken by a user.

The blister pack 20 is provided with a tab 28 that fits into a notch 30 formed in the sidewall 14 of the tray 12. With this arrangement, the first tablet of the regimen to be taken is located in the required position over the dispensing opening 11 in the support 4. The pill package 20 is positively retained in position in the tray of the pill dispenser by a hat-shaped indicator member 32 that fits over an inner circumferential portion 34 of the pill package (see FIG. 4). The indicator member 32 is retained in position relative to a hub member 36 formed integral with the support 4 and contains on its upper surface the desired indicia 40 which in this case is the days of the week. The indicator member 32, which when assembled in the dispenser thus prevents removal of the blister pack.

Referring now to FIG. 2, the various components of the pill dispenser 2 are shown in an exploded perspective which, starting from the bottom, includes the support member 4, the tray 12, and above the tray is shown a portion of the pill package 20 along with the hat-shaped indicator mechanism 32.

The structural details of the various components will now be described. Referring first to the support 4, it is noted that this support includes an integral central hub member 36 that is supported by rigid spokes 42 extending up from and integral with the bottom wall 10 of the support 4. The upper surface 38 of the hub is a flat circular section on which is formed a pointer 44. The pointer is directed at the pill dispensing opening 11 formed in the bottom wall 10 of the support 4. When an opening 18 of the tray containing the pill package 20 is located above the dispensing opening 11, a pill 22 from a plastic compartment 24 of the pill package can be dispensed by removing it from the pill package through the opening 18 in the tray 12 and the aligned dispensing opening 11 in the bottom wall 10 of the support.

The tray 12 is retained in position relative to the support 4, but is rotatable in one direction with respect thereto. The tray defines a central opening 13 which is slightly larger than the hub 36 and is disposed thereover above the bottom wall 10 of the support 4. Tray 12 is retained in position within the support 4 by circumferentially spaced resilient spokes 46 which define projections 48 that are spaced above the bottom wall 10 an amount sufficient to retain the tray 12 in its proper position. During assembly, the tray is pressed down over the hub 36 and the resilient spokes 46, after which the spoke projections 48 retain the tray in position adjacent the bottom wall 10.

The tray contains a plurality of downwardly extending flexible projections 50 located between the tray sidewall 14 and tray openings 18. These projections 50 are designed and located to engage with ratchet-shaped teeth 52 formed on the upper surface of the bottom wall 10 of the support 4 adjacent its outer periphery. The spacing between the projections 48 and the support bottom wall 10 is such that the projections 50 are in mating engagement with the teeth 52. The interengaging teeth 52 and projections 50 provide for the free clockwise movement of the tray relative to the support 4, but prohibit counterclockwise movement of the tray. The number of teeth 52 corresponds to the number of tray openings 18 and the pills in the pill package so that indexing movement of the tray from one tooth to the next will place succeeding pills in position to be dispensed. This type of construction permits the tray to be sequentially moved relative to the support in a clockwise direction to place a succeeding tablet into position to be dispensed through the dispensing opening in the support by the user in the desired sequence.

There remains to be described the adjustable indicating mechanism which permits the user to preselect the day the first pill of the regimen is to be taken. The indicating mechanism is generally hat-shaped and is assembled in the dispenser after the tray and pill package are located in position in the support 4. The indicator member 32 fits over projections 54 of a plurality of flexible spokes 56 of the hub 36 to retain the indicator 32 in position relative to the tray 12 and support 4. As shown in FIG. 4, the spokes 56 have a shorter axial dimension than spokes 46, and they are located between adjacent spokes 46.

As clearly shown in FIG. 4, the indicator member 32 when placed in position in the dispenser locates its annular flange portion 33 over the inner circumferential portion 34 of the pill package 20. Thus, when the blister package 20 is located in the tray 12 and the indicator 32 is placed in position on the hub 36 to retain the blister package 20 in position within the tray relative to the pill dispenser, the package 20 is secured in position and cannot be removed from the dispenser 2 without damage thereto.

As previously mentioned, in the embodiment illustrated in FIGS. 1–10, the first pill of the dispenser is to be taken at a day to be selected by the user. Thus, it is important that the indicating mechanism be adjustable relative to the tray so that the proper day can be indicated for taking the first tablet of the regimen that is prepositioned to be in alignment with the pointer 44 and the dispensing opening 11 in the bottom wall 10 of the support 4. As indicated previously, the blister package 20 is placed in the tray 12 by locating the tab 28 of the blister package in the notch 30 of the tray. This will place the first tablet of the regimen in alignment with the pointer and locate it over the dispensing opening 11 in the support 4. Thus, if the indicator is movable relative to the tray, then the to be selected first day can be set by the user.

As described hereinbefore, the tray 12 and support 4 have interengaging teeth 50,52 which permit movement of the tray 12 relative to the support 4 in the clockwise direction, but prohibit movement of the tray in the reverse direction. In the case of the indicating mechanism, there are provided teeth 58 on its underside which cooperate with teeth-type projections 60 extending upwardly from flexible tongue members 62 formed in the base of the tray between the center opening 13 and tray openings 18. These interengaging teeth 58 and projections 60 interact to permit counterclockwise movement of the indicator relative to the tray, so that the indicator can be rotated relative to the tray to indicate the proper first day at which the first pill is to be taken. (See FIGS. 9 and 10.)

In the embodiment illustrated in FIGS. 1–10, the indicator defines an upper surface 64 which has marked thereon the days of the week over a three-week period. Thus, with this kind of indicia, once the first day is set and the indicator is fixedly positioned relative to the tray 12, movement of the tray 12 will direct the user to take special prearranged pills on a daily basis over the prescribed three-week period. While a three-week period dispenser is illustrated, the instant embodiment can be made for whatever period desired, such as, a four-week period in the embodiment illustrated in FIGS. 11–13.

While it may be desirable that the indicator 32 be movable relative to the tray to preset the proper day of the week that the first pill is to be taken, it is also desirable that once this setting is accomplished that the indicator 32 not be adjustable relative to the tray 12 so that an accidental presetting or an inaccurate setting of the indicator can take place. To this end, an interlock mechanism is provided so that once the indicator 32 has been set relative to the tray, the first pill taken, and the tray 12 moved to place the second pill into position to be dispensed, the indicator 32 will be locked in position relative to the tray. With such an arrangement, the indicator cannot be moved relative to the tray until the blister package has been completely used up, which is when the tray has been moved around a full 360°.

The details of the interlock mechanism can be best seen by referring to FIGS. 2, 4, 5, 7, and 9. A notch 66 is formed in the upper surface of the bottom wall 10 of the support between the pointer 44 and the dispensing opening 11 and a series of circumferentially spaced recesses 68 (shown in dotted lines in FIG. 3) are formed in the inner sidewall of the indicator member 32. Formed with the tray 12 is a flexible member 70 containing a downwardly extending lug 72 and an upwardly extending peg 74. The lug is positioned to move in and out of engagement with the notch 66 and the peg 74 moves relative to the recesses 68. When the tray 12 is in the starting position, which is where the first pill in the regimen is in position to be taken, the lug 72 is disposed in notch 66 and the peg 74 is out of engagement with a recess 68 of the indicator 32 and thus the indicator mechanism is free to move counterclockwise relative to the tray, as shown in FIG. 9. However, when the tray 12 moves relative to support 4, the lug 72 is forced out of the notch 66 and into engagement with a recess 68 in the indicator member to prevent movement of the indicator relative to the tray 12. The number of recesses 68 located around the inner sidewall of the indicator corresponds to the number of indicating periods located on the indicator upper surface 64. Thus, in the case of there being a three-week period, or twenty-one days, there are twenty-one recesses located in the undersurface of the indicator.

In accordance with the above novel interlock construction, when the tray is in the position prior to removal of the first pill, the lug 72 is located in the notch 66 which thus places the upwardly extending peg 74 out of contact with the indicator, thus permitting it to be moved in a counterclockwise direction relative to the tray. However, when the tray is moved to dispense a second pill, the lug 72 will be removed from the notch, which will then force the peg 74 into a recess 68 on the undersurface of the indicator to prevent movement of the indicator relative to the tray until the tray has been moved a full 360° degrees to again place the lug in the notch 66.

Turning now to the embodiment shown in FIGS. 11–13, there is illustrated a pill dispenser of the four-week variety that is similar in many respects to that illustrated in FIGS. 1–10. The various components that are substantially identical to those illustrated in FIGS. 1–10 have been given the same numerals, and their description will not be repeated unless required in discussing the features present in this embodiment which are not found in the embodiment of FIGS. 1–10.

Specifically, this second illustrated embodiment is a pill dispenser wherein the pill dispenser is produced with the indicator 86 fixed relative to the tray 80 and the blister pill package 20 is locked in position between the indicator and the tray. Thus, the pill package cannot be removed from the tray. In addition, the initial position of the indicator, tray and pill package is preset so that the first pill of the regimen is taken on a preset day, which in the illustrated embodiment is Sunday. Indicator 86 is similar to the indicating mechanism illustrated in the embodiments of FIGS. 1–10 in that it fits over hub 36 and is axially retained by projections 54. Similarly, it is provided with indicia 40 on its upper annular surface. However, it cannot be adjusted to change the day the first pill of the regimen is to be taken.

Since in this embodiment the indicator is not intended to be adjustable relative to the tray, provision is made to affix the indicator so that it cannot be moved relative to the tray. As shown in FIG. 13, the indicator is axially positioned relative to the base member 14 by being disposed over the projections 54 of the flexible spokes 56, which is similar to that illustrated in FIG. 4. The projections 54 interengage with the inwardly extending annular lip 89. Rotation of the indicator 86 relative to the tray 80 is prevented by the interaction between lugs 82 extending upwardly from the base of the tray, which lugs 82 fit into notches 88 formed in the undersurface of the indicator. As shown in FIG. 13, it is seen that the lugs 82 and notches 88 cooperate so that rotation of the indicator 86 relative to the tray 80 is prevented.

As shown in FIG. 13, removal of the pill package 20 from the tray is precluded by the retention of the annular surface 34 of the pill package 20 between the annular flange 87 of the indicator mechanism 86 and the upper surface of the bottom of the tray 80.

The embodiments illustrated in FIGS. 11–13 is assembled as follows:

The tray opening 84 of the tray 80 is placed over hub 36, and the tray is held in place relative to the base 4 by projections 48. Pill package 20, which has been produced in a prescribed manner to properly indicate the order in which certain pills are to be taken, is placed in the tray 80 with the tab 28 disposed in notch 30. The indicator 86 is then placed over hub 36 with the preset day, i.e., Sunday, in alignment with the pointer 44, tray opening 18, and base opening 11. The projections 54 retain the indicator against axial movement and the interengaging lugs 82 and recesses 88 prevent the indicator from rotating relative to the tray 80. When the indicator 86 is placed in position, the flange 87 locks the pill package 20 in the tray 80.

In accordance with the above novel construction, it can be seen that there is provided a dispenser in which the pill package is positively located in place and cannot be removed therefrom to permit substitution of an inferior product. Also, in one embodiment, the first day of the regimen can be set by the user, and once the first day of the indicating mechanism has been set and the first pill taken, the moving of a tray to take a second pill locks the indicating mechanism to the tray to prevent relative movement between the indicating mechanism and tray, which prevents accidental resetting of the indicator.

It is intended to cover by the appended claims all such modifications as fall within the true spirit and scope thereof.

What is claimed is:

1. A pill dispenser comprising: a substantially flat support defining a single pill dispensing aperture therein; a tray rotatably connected to said support, said tray having a plurality of openings therein; said openings disposed in a generally circular orientation and spaced substantially equidistantly apart, said openings arranged to individually align in registration with said aperture in said support upon rotation of said tray relative to said support, means for providing incremental rotation of said tray on said support to align each opening with said aperture as each individual opening passes thereover, and to maintain said alignment until said tray is incrementally rotated to the next opening by the user thereof, a removable pill package disposed on said tray comprising a plurality of dispensing pockets each containing a pill therein, said pockets arranged in a circular orientation and substantially equally spaced apart to thereby correspond with the orientation of said openings in said tray so that a pill is disposed in alignment with each of said openings, said package being positively located with respect to said tray and rotatable therewith, whereby the pills can be dispensed when a tray opening is in registry with said aperture by the user thereof; a periodicity indicator rotatably connected to said support above said tray and associated with each of said openings, interengaging means defined by said indicator and tray whereby said indicator can be moved relative to said tray and will move with said tray when the tray is moved to sequentially place its openings into position to dispense pills to the user, said adjustability of the indicator relative to the tray permits the indicator to be preset to indicate when the various pills in the pill package are to be taken, and interlock means for preventing movement of the indicator relative to the tray after the first pill has been dispensed and the tray has been moved to dispense a subsequent pill.

2. A pill dispenser comprising: a substantially flat support defining a single pill dispensing aperture therein; a tray rotatably connected to said support, said tray having a plurality of openings therein; said openings disposed in a generally circular orientation and spaced substantially equidistantly apart, said openings arranged to individually align in registration with said aperture in said support upon rotation of said tray relative to said support, means for providing incremental rotation of said tray on said support to align each opening with said aperture as each individual opening passes thereover, and to maintain said alignment until said tray is incrementally rotated to the next opening by the user thereof, a removable pill package disposed on said tray comprising a plurality of dispensing pockets each containing a pill therein, said pockets arranged in a circular orientation and substantially equally spaced apart to thereby correspond with the orientation of said openings in said tray so that a pill is disposed in alignment with each of said openings, said package being positively located with respect to said tray and rotatable therewith, whereby the pills can be dispensed when a tray opening is in registry with said aperture by the user thereof; a periodicity indicator rotatably connected to said support above said tray and associated with each of said openings, interengaging means defined by said indicator and tray whereby said indicator can be moved relative to said tray and will move with said tray when the tray is moved to sequentially place its openings into position to dispense pills to the user, said adjustability of the indicator relative to the tray permits the indicator to be preset to indicate when the various pills in the pill package are to be taken, said indicator defining a flange portion overlying at least a portion of said pill package, whereby the pill package cannot be removed from said dispenser, and interlock means for preventing movement of the indicator relative to the tray after the first pill has been dispensed and the tray has been moved to dispense a subsequent pill.

3. A pill dispenser as defined in claims 1, or 2, wherein said support includes a raised hub substantially centrally located on said support and wherein said tray and indicator each defines a substantially central hole therethrough to fit over said hub, said hub including flexible projection means that axially positions said tray relative to said support and said indicator relative to said support and tray.

4. A pill dispenser as set forth in claim 3 in which the indicator is generally hat-shaped and defines an upper surface generally parallel to the upper surface of said hub and the indicator contains indicia marked thereon which to be in alignment between a pointer on said hub and the dispensing openings.

5. A pill dispenser in accordance with claims 1, or 2 in which the interengaging means for controlling movement between the indicator and said tray includes cooperating ratchet teeth disposed on said indicator and tray.

6. A pill dispenser in accordance with claim 5 in which the teeth of said tray are formed on flexible projections formed as part of said tray.

7. A pill dispenser as set forth in claims 1 or 2 in which the interlock means for preventing movement of the indicator relative to the tray comprises flexible means defined by said tray that is constructed and arranged to cooperate with the support and indicator.

8. A pill dispenser as set forth in claim 6 in which said interlock means includes peg and lug members extending from opposite sides of said flexible means, said lug member adapted to engage with a notch defined by said support when said indicator is free to be rotated relative to said tray and said peg member adapted to engage a recess defined by said indicator to interlock the tray and indicator after a first pill is dispensed and the tray rotated to dispense a second pill.

9. A pill dispenser as set forth in claims 1, or 2 including a cover member hingedly secured to said support.

10. A pill dispenser as set forth in claim 1 or 2 in which the periodicity indicator and tray define cooperating lugs and recesses to form said interlock means whereby the indicator cannot be moved relative to said tray.

11. A pill dispenser in accordance with claim 10 in which the lugs extend upwardly from said tray and the recesses are located in the undersurface of said indicator.

* * * * *